US006860841B1

(12) United States Patent
Mortorano

(10) Patent No.: US 6,860,841 B1
(45) Date of Patent: Mar. 1, 2005

(54) EXERCISE DEVICE WITH INTEGRATED HANDLE AND STOPPING DEVICE

(76) Inventor: Michael Peter Mortorano, 3042 N. Monticello, Chicago, IL (US) 60618

( * ) Notice: Subject to any disclaimer, the term of this patent is extended or adjusted under 35 U.S.C. 154(b) by 488 days.

(21) Appl. No.: 10/116,484

(22) Filed: Apr. 4, 2002

Related U.S. Application Data

(63) Continuation-in-part of application No. 09/974,616, filed on Oct. 6, 2001, now abandoned.

(51) Int. Cl.[7] ..... A63B 21/055
(52) U.S. Cl. ..... 482/126; 482/139; 482/908
(58) Field of Search ..... 482/82, 121–126, 482/129, 130, 139, 908; 16/428

(56) References Cited

U.S. PATENT DOCUMENTS

| | | | | | |
|---|---|---|---|---|---|
| 685,788 | A | * | 11/1901 | MsFadden | 482/129 |
| 4,093,211 | A | * | 6/1978 | Hughes et al. | 482/49 |
| 4,375,886 | A | * | 3/1983 | Muys | 482/82 |
| 4,733,862 | A | * | 3/1988 | Miller | 482/126 |
| 4,762,318 | A | * | 8/1988 | Phillips et al. | 482/126 |
| 5,022,648 | A | | 6/1991 | Travis | 272/137 |
| 5,514,059 | A | | 5/1996 | Romney | 482/124 |
| 5,549,532 | A | * | 8/1996 | Kropp | 482/126 |
| 5,571,064 | A | | 11/1996 | Holm | 482/129 |
| 5,643,149 | A | * | 7/1997 | Grimaldi et al. | 482/82 |
| 5,791,022 | A | | 8/1998 | Bohman | 24/130 |
| 6,022,302 | A | | 2/2000 | McBride | 482/121 |
| 6,036,626 | A | | 3/2000 | Taylor | 482/121 |
| 6,238,324 | B1 | | 5/2001 | MacMillan | 482/121 |
| 6,398,698 | B1 | * | 6/2002 | Hinds | 482/126 |

* cited by examiner

*Primary Examiner*—Justine R. Yu
*Assistant Examiner*—Victor K. Hwang
(74) *Attorney, Agent, or Firm*—Welsh & Katz, Ltd.

(57) ABSTRACT

An exercise device, having a pair of handles—namely a first handle and second handle, and an elastic cord extending through the handles. The elastic cord has a fixed end, the first handle located adjacent to the fixed end. The second handle located along the elastic cord further away from the fixed end than the first handle. The second handle can selectively slide freely along the elastic cord toward and away from the first handle. A stopping device is attached to at least one of the first handle and second handle. The stopping device is capable of fixing the position of its associated handle along the elastic cord so that the elastic cord may then be tensioned to allow exercises to be performed.

15 Claims, 3 Drawing Sheets

EXERCISE DEVICE WITH INTEGRATED HANDLE AND STOPPING DEVICE

CROSS REFERENCES AND RELATED SUBJECT MATTER

This application is a continuation-in-part of patent application Ser. No. 09/974,616, filed in the United States Patent Office on Oct. 6, 2001, now abandoned.

BACKGROUND OF THE INVENTION

The invention relates to an exercise device. More particularly, the invention relates to an exercise device which employs an elastic cord and a pair of handles to allow a variety of exercises to be performed, such that one or more of the handles has a stopping device which allows the user to selectively fix the position of the stopping device along the elastic cord so that the elastic cord can be tensioned between the two handles.

For those who seek to maintain a toned physique, it is essential to keep a consistent exercise schedule in which exercises are performed that isolate target muscle groups. Since weight lifting and resistance based exercise machines are a typical part of such a regimen, frequent travel to the gym is a necessity.

Considering the work, school, and travel schedule of many individuals, it is not always possible to travel to the gym. Rather than skip the workout altogether, many athletes will perform stretching exercises, push-ups, sit-ups, etc. Although such exercises are good for maintaining overall conditioning, they lack the ability to isolate and tone specific muscles.

Some attempts have been made to provide compact and lightweight devices for performing toning exercises at any location. One such type of exercise device employs an elastic cord, and a pair of handles fixed to the ends of the cord. Such portable exercising devices are generally inexpensive, convenient for use, and are useful for physical conditioning—particularly in exercising upper body muscles. The typical elastic exercising device provides resistance against which the user exerts force during exercising.

However, many elastic exercising devices provide only constant resistance, which limits such devices to being used to exercise only particular muscles or groups of muscles. In addition, such devices fail to challenge a user as the user's strength increases.

U.S. Pat. No. 5,514,059 to Romney attempts to solve the problem by having a flexible tubular member, located midway between the handles, from which a loop of cord is drawn out to adjust the distance between the handles, and wrapped around the tubular member with a strap, purportedly to hold the loop of cord in place during exercise. However, such an arrangement cannot reliably maintain the length adjustment and resist the cord tension exerted by a strong user. Further, if the strap were to fail and the loop were to be suddenly released while the device is in use and under tension, it would very likely injure the user.

U.S. Pat. Nos. 5,571,064 to Holm, 6,036,626 to Taylor, and 6,238,324 to MacMillan all disclose various exercise devices which employ an elastic cord in various configurations. U.S. Pat. Nos. 6,022,302 to McBride and 5,022,648 to Travis disclose exercise devices which use a flexible tube to provide resistance.

While these units may be suitable for the particular purpose employed, or for general use, they would not be as suitable for the purposes of the present invention as disclosed hereafter.

SUMMARY OF THE INVENTION

It is an object of the invention to provide an exercise device which is capable of toning individual muscle groups of a user, as well quickly "pumping up" the muscles of the user. Accordingly, the invention provides an exercise device which is useable in a variety of different positions, and adaptable to a variety of different exercises to meet such goals.

It is another object of the invention to provide an exercise device which is portable and inexpensive. Accordingly, in simple terms, the exercise device comprises an elastic cord, and a pair of handles, each handle preferably having a stopping device integrated with the handle. The components of the exercise device are lightweight, and are simple in construction so that they may be inexpensively manufactured and assembled.

It is a further object of the invention that the exercise device can be easily adjusted to vary the resistance and distance between the handles to accommodate different exercises and different users. Accordingly, at least one of the handles is movable along the cord to set a desired position relative to the other of the handles, yet is then prevented from movement along the elastic cord by the stopping device.

The invention is an exercise device, having a pair of handles—namely a first handle and second handle, and an elastic cord extending through the handles. The elastic cord has a fixed end, the first handle located adjacent to the fixed end and prevented from movement past the fixed end. The second handle located along the elastic cord further away from the fixed end than the first handle. The first handle and second handle can slide freely along the elastic cord toward and away from each other. A stopping device is located on the second handle fully opposite from the first handle. The stopping device is capable of allowing adjustment of the relative position of the second handle along the cord and selectively locking to the elastic cord to prevent the second handle from moving so that the elastic cord may then be tensioned to allow exercises to be performed.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
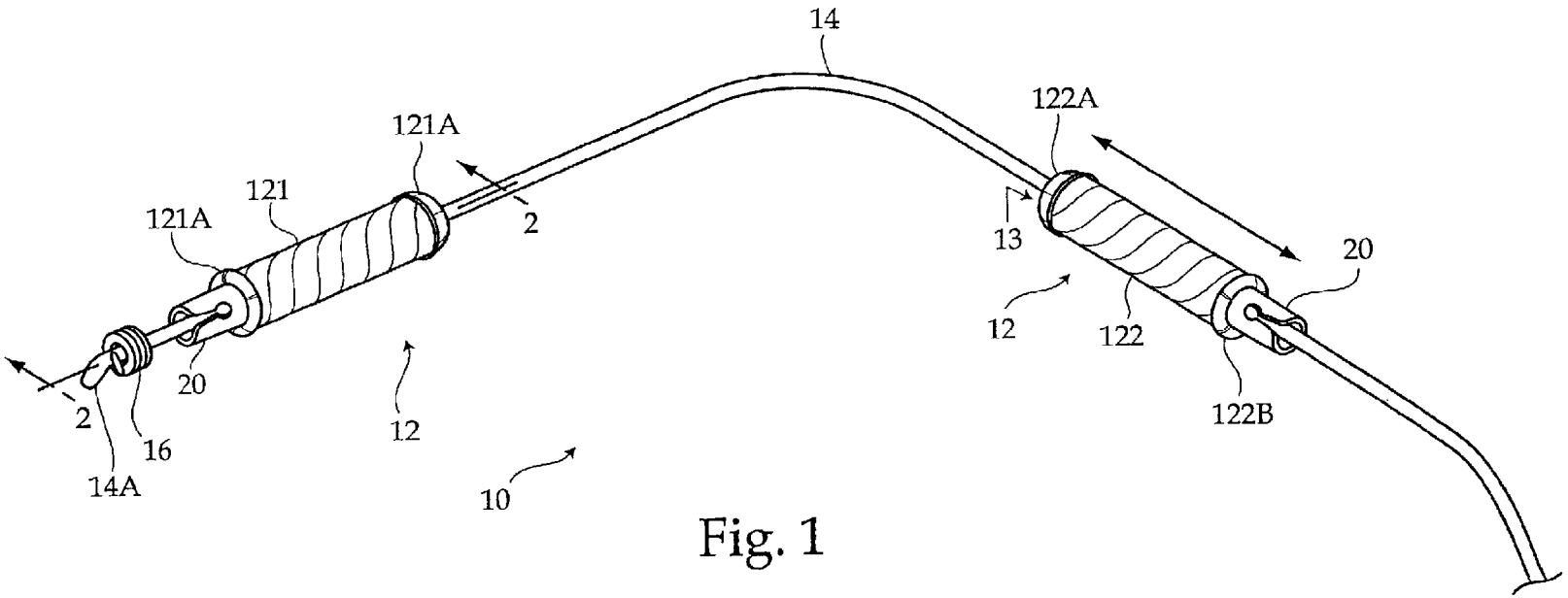
FIG. 1 is a diagrammatic perspective view, illustrating the invention, per se.

FIG. 1 illustrates an exercise device 10. The device 10 includes a pair of handles 12, each having a central longitudinal bore 13, and an elastic cord 14 which extends through the central longitudinal bore 13 of both handles 12. The elastic cord 14 has a relaxed diameter when substantially un-tensioned, and has a tendency to narrow when tensioned and stretched.

The handles 12 include a first handle 121 and a second handle 122. The elastic cord 14 has a fixed end 14A having a fixed coupling 16. The first handle 121 is located nearest to the fixed end 14A. The fixed coupling 16 may be employed to prevent the first handle 12 from moving past the fixed end 14A, and in effect limits longitudinal movement of the first handle 121 along the elastic cord 14. The first handle 121 and second handle 122 each have inner ends 121A and 122A, and outer ends 121B and 122B. The inner ends 121A and 122A face each other, while the outer ends 121A and 122B are fully opposite and face away from each other.

The second handle 122 is located on the elastic cord 14 further away from the fixed end 14A than the first handle 121. The second handle 122 is ordinarily freely movable along the elastic cord 14—both toward and away from the first handle 121.

Figure 3:
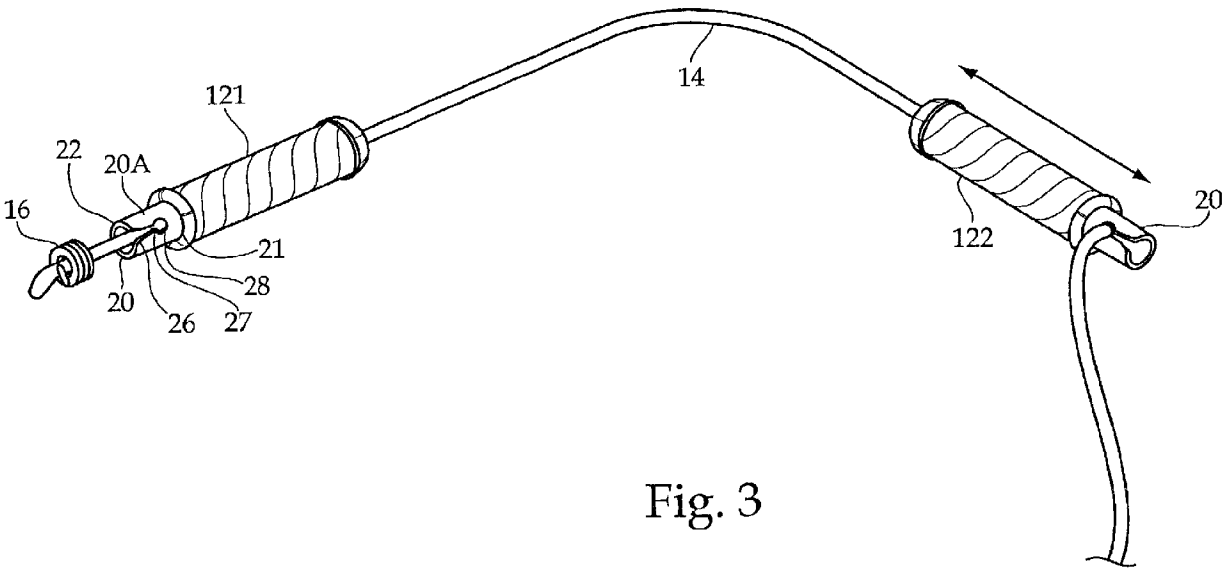
FIG. 3 is an elevational view wherein the stopping device of the present invention is being used to fix the position of the second handle on the elastic cord.

The second handle 122 has a stopping device 20 at its outer end 122B, thus located further on the elastic cord than the remainder of the second handle 122. The stopping device 20 allows the second handle 122 to be selectively moved along the elastic cord 14, as seen in FIG. 1, and selectively locked in position on the elastic cord 14 as seen in FIG. 3 to act as a stop for the second handle 122, to prevent the second handle 122 from moving further away from the first handle 121 along the elastic cord 14. In addition, the stopping device 20 can also prevent the second handle 122 from moving toward the first handle 121. Generally, when the exercise device 10 is in use and being tensioned, the user would be pulling the handles away from each other, and such movement is limited by the stopping device 20 at the second handle 122, and by the fixed coupling 16 at the first handle 121.

However, as illustrated in the drawings figures, the first handle 121 may also have the stopping device 20 at its outer end 121B. The stopping device 20 of the first handle 121 can be used to selectively prevent movement of the first handle 121 along the elastic cord 14. Accordingly during usage of the exercise device, the user can choose to rely upon the fixed coupling 16 to simply limit movement of the first handle 121 away from the second handle, or can use the stopping device 20 of the first handle to actually fix a position of the first handle 121 on the elastic cord 14.

Figure 2:
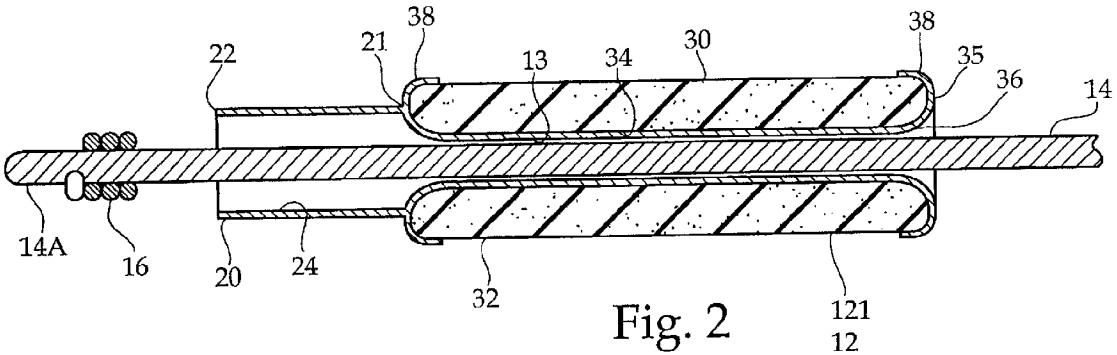
FIG. 2 is a cross sectional view, taken generally in the direction of line 2—2 in FIG. 1.

FIG. 2 is a cross sectional view, illustrating the first handle 121. It is specifically the first handle 121, because of its orientation and its illustrated proximity to the fixed coupling 16 and the fixed end 14A. However, structurally it is substantially the same as the second handle 122 or at least a mirror image thereof, so it may be referred to as simply "the handle 12".

The handle 12 comprises a handle tube 30 which is soft, pliable, flexible, yet strong, and is preferably made of foam or rubber. The handle tube 30 has a handle tube exterior 32, a handle tube bore 34, and a pair of handle tube ends 35. The handle tube exterior 32 is grasped by the user during use. A collar tube 36 extends through the handle tube 30, through the handle tube bore 34. The collar tube 36 is rigid, typically made of metal, and has a pair of curled ends 38. The elastic cord 14 specifically extends through the collar tube 36. The curled ends 38 of the collar tube 36 prevent abrasion to the elastic cord 14, and thus prevent undue wear to said cord 14 as the exercise device 10 is used. The curled ends 38 flare outward from the handle tube bore 34 at the handle tube ends 35, to cover the handle tube ends and thus maintain the handle tube 30 in position around the collar tube 36. Thus, each of the curled ends 38 on one of the handles 12 preferably also return inward toward the other curled end 38 on said handle 12, making a substantially one hundred eighty degree turn which overlaps the handle tube exterior 32 and fully integrates the handle tube 30 with the collar tube 36, and prevents it from sliding or slipping off the collar tube 36.

The stopping device 20 extends from the collar tube 36, at the outer end 121B of the handle tube 30, and is shown to extend specifically from the curled end 38 of the collar tube 36. The stopping device 20 is tubular, coaxial with the handle, having a first stopping device end 21 and a second stopping device end 22. A stopping device bore 24 extends between the stopping device ends 21 and 22, through which the elastic cord 14 extends. Thus, the stopping device bore 24 is substantially coaxial with the handle tube bore 34 and central longitudinal bore 13 of the handle 12.

Referring to FIG. 3, the stopping device 20 has a side wall 20A having a slot 26 which extends from the second stopping device end 22 partially toward the first end 21, and slightly less in width, or tapered to be slightly less in width, than the diameter of the elastic cord 14 when relaxed. The slot 26 is cut into the side wall 20A, and thus extends parallel to the stopping device bore 24. The slot 26 has a neck 27 which is the narrowest portion of the slot 26 and is fully opposite from the second end 22. Adjacent to the slot 26 is a circular opening 28, which is slightly larger than the neck.

Figure 4:
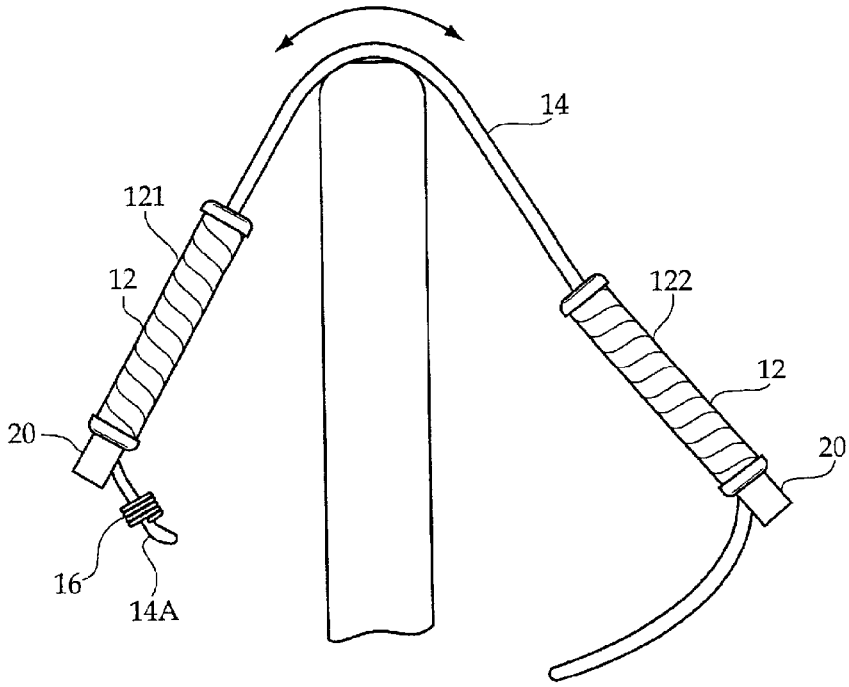
FIGS. 4 and 5 are side elevational views, illustrating different operative positions, wherein the handle positions have been set by the user as desired, and the invention is shown being pulled downward over a fixed item by the handles to tension the elastic cord.
Figure 5:
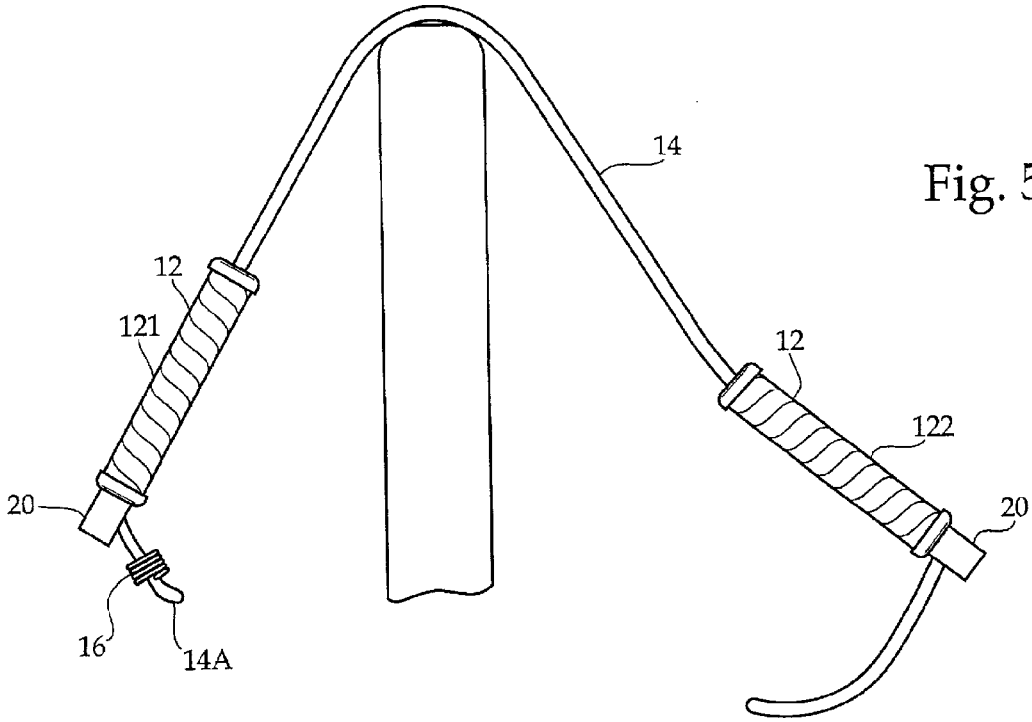

To move the stopping device 20 along the elastic cord 14, the elastic cord 14 must extend axially between the first end 21 and second end 22 of the stopping device 20. Then the handle 12 associated with said stopping device 20 can move freely along the elastic cord 14, and the elastic cord 14 can move therethrough. However, to fix the position of the handle 12 along the elastic cord, the cord 14 is held rigidly near the inner end 121A or 122A of the handle 12, and is pulled adjacent to the second end 22 of the stopping device 20 toward the outer end 121B or 122B or said handle 12 at a right angle to the second end 22 of said stopping device 20 and the axis of the cord 14: stretching and thus narrowing the elastic cord 14; urging the elastic cord 14 into the slot 26 and towards the neck 27; and then pulling the elastic cord 14 past the neck 27 until it enters the circular opening 28 at a right angle. When released, the elastic cord 14 will expand slightly within the circular opening 28. Because of the narrowing of the slot 26, and the slightly larger circular opening 28, the cord 14 has a tendency to stay in the circular opening 28 once released and somewhat relaxed, and remains at a right angle from the remainder of the elastic cord 14 and from the stopping device itself 20, as illustrated in FIGS. 3, 4, and 5. This bend acts to prevent the elastic cord 14 from longitudinal movement. In this locked position, the stopping device 20 will not move along the elastic cord 14. Thus, referring to FIG. 4 and FIG. 5, when so locked, the second handle 122 cannot move along the elastic cord 14. Accordingly, during exercises any tension against the handles 12 will in turn tension the elastic cord 14—as desired. Alternatively, if only the second handle 122 is fixed in position, the first handle 121 is slid to its extreme position at the fixed end 16, and then the elastic cord 14 can be tensioned by pulling the first handle 121 and second handle 122 away from each other.

FIG. 4 and FIG. 5 illustrate two different operative positions for the handles 12. The stopping devices 20 are both in use, holding the adjustment of the handles 12 along the elastic cord 15. The handles 12 have been adjusted in FIG. 5 so that the handles 121 and 122 are further away from each other than in FIG. 4. After selecting a desired exercise, the user would suitably adjust the second handle 122 and possibly the first handle 121. If the first handle 121 is not going to be fixed in position, to set a minimum position—that is the minimum distance between handles desired for the chosen exercise—the first handle 121 is slid along the elastic cord 14 until it abuts the fixed coupling 16 at the fixed end 14A. Alternatively, other means could be used to permanently fix the position of the first handle 121 with respect to the elastic cord 14. Then, the position of the second handle 122 is locked with its stopping device 20 in the manner previously described. Once the minimum exercise distance (or the limit of un-tensioned travel) is set, various exercises can be performed by tensioning the elastic cord by pulling the handles away from each other.

However, if the first handle 121 is also to be selectively fixed in position along the elastic cord 14 by using its stopping device 20, then the "minimum distance" is strictly relative between the handles 121 and 122, and can be established at various points along the elastic cord 14.

It should be noted that in FIG. 1, the elastic cord 14 is shown as having arbitrary length, with no end shown opposite the fixed end 14A. The actual length of the cord 14 can be chosen according to an anticipated range in the size of the users and of the types of exercises that may be performed. Further, another limiting device, like the fixed coupling 16 or equivalent structures, may be placed opposite the fixed end 14A, so that both ends have such fixed couplings 16 or suitable limiting devices.

In conclusion, herein is presented an exercise device which allows a variety of toning and pumping exercises to be performed, while allowing adjustment for different users and for different exercises. The invention is illustrated by example in the accompanying drawing figures and in the foregoing description. However, numerous variations may be made while adhering to the inventive concept. Such variations are considered a part of the present invention.

What is claimed is:

1. An exercise device, comprising:

a pair of handles, including a first handle and a second handle, each of the handles having an inner end and an outer end, the first handle and second handle having a longitudinal central bore;

an elastic cord, the elastic cord extending longitudinally through the first handle and second handle, the elastic cord having a fixed end, the first handle located adjacent to the fixed end with the outer end of the first handle facing the fixed end, the second handle located on the elastic cord on an opposite side of the first handle than the fixed end wherein the inner ends of the handles face each other, the second handle capable of sliding freely toward and away from the first handle along the elastic cord; and a stopping device integral with the outer end of the second handle, located on the elastic cord further away from the fixed end than the first handle and second handle, the stopping device capable of selectively locking the position of the second handle on the elastic cord to prevent the second handle from moving along the elastic cord.

2. The exercise device as recited in claim 1, wherein the stopping device further comprises a first end, a second end, and a bore extending from the first end to the second end, the bore coaxial with the handle, the elastic cord extending through the bore to selectively allow the stopping device to move freely along the elastic cord with the elastic cord traveling from the first end to second end, and selectively preventing movement of the elastic cord through the stopping device bore, the first end of the stopping device attached to the second handle to selectively prevent movement of the second handle along the elastic cord.

3. The exercise device as recited in claim 2, wherein the stopping device has a side wall having a slot extending parallel to the bore from the second end partially toward the first end, so the elastic cord may be pulled up at a right angle from the second end into the slot to lock the stopping device in place along the elastic cord.

4. The exercise device as recited in claim 3, wherein the elastic cord has a relaxed diameter and narrows when tensioned; and wherein the slot is slightly narrower than the relaxed diameter of the elastic cord.

5. The exercise device as recited in claim 4, wherein the slot has a neck and a circular opening adjacent to the neck; wherein the neck is narrower than the circular opening; and wherein once the elastic cord is pulled past the neck into the circular opening it expands slightly and is maintained within the circular opening.

6. The exercise device as recited in claim 5, wherein the handle includes a handle tube made of a soft, flexible material, the handle tube has a handle bore coaxial with the stopping device bore and a pair of handle tube ends; wherein a collar tube extends through the handle tube bore, the elastic cord extending through the collar tube; and wherein the collar tube has curled ends which extend partially over the handle tube ends.

7. The exercise device as recited in claim 6, wherein the first handle has a stopping device affixed to the outer end of said first handle to selectively fix the first handle along the elastic cord.

8. The exercise device as recited in claim 7, wherein the stopping device affixed to the first handle further comprises a first end, a second end, and a bore extending from the first end to the second end, the elastic cord extends through the bore to selectively allow the stopping device to move freely along the elastic cord with the elastic cord traveling from the first end to second end, and selectively preventing movement of the elastic cord through the stopping device bore, the first end of the stopping device affixed to the first handle.

9. An exercise device method, using an exercise device having a pair of handles including a first handle and a second handle, an elastic cord extending through the second handle, the elastic cord having a fixed end, the first handle attached onto the cord near the first end, the second handle located one the cord further from the fixed end than the first handle, and a stopping device integral with the second handle further from the fixed end than the first and second handles, comprising the steps of:

sliding the second handle to a desired minimum position relative to the first handle;

locking the position of the second handle with the stopping device to fix the position of the second handle on the elastic cord; and exercising with the exercise device by tensioning the elastic cord by urging the first handle and second handle away from each other.

10. The exercise device method as recited in claim 9, wherein the stopping device is tubular, the stopping device having a first end, a second end, and a stopping device bore between the first end and the second end which is coaxial with the second handle, wherein the elastic cord extends through the stopping device bore, and wherein the step of sliding the second handle to a desired minimum position further comprises allowing the elastic cord to move freely between the first end and second end through the stopping device bore.

11. The exercise device method as recited in claim 10, wherein the stopping device further has a side wall and a slot in the side wall extending from the second end, and wherein the step of locking the position of the stopping device further comprises pulling the elastic cord up into the slot at a right angle.

12. An exercise device method, using an exercise device having a pair of handles including a first handle and a second handle, first handle and second handle having outer ends which face away from each other and inner ends which face toward each other, stopping devices are integral with the first handle and the second handle at the outer ends thereof, an elastic cord extends through the handles and the stopping devices and allowing the handles to selectively slide freely along the elastic cord, the elastic cord having a fixed end, comprising the steps of:

sliding the first handle to a desired position along the elastic cord;

sliding the second handle to a desired minimum position along the elastic cord relative to the first handle;

locking the position of the stopping devices of the first and second handles to fix the position of the first and second handles on the elastic cord; and exercising with the exercise device by tensioning the elastic cord by urging the first handle and second handle away from each other.

13. The exercise device method as recited in claim 12, wherein each stopping device has a first end, a second end, and a stopping device bore between the first end and the second end; wherein the stopping device bores are coaxial with their associated handle, the elastic cord extends through the stopping device bore; and wherein the steps of sliding the second handle to a desired minimum position further comprises allowing the elastic cord to move freely between first end and second end through the stopping device bore of the stopping device affixed to the second handle.

14. The exercise device method as recited in claim 13, wherein the stopping device further has a slot extending from the second end parallel to the bore; and wherein the step of locking the position of the stopping device further comprises pulling the elastic cord up into the slot at a right angle to the bore.

15. The exercise device method as recited in claim 14, wherein the elastic cord has a relaxed diameter yet narrows when tensioned, the slot of stopping device narrows toward a neck, each stopping device has a circular opening adjacent to the neck which is slightly larger than the neck, and wherein the step of locking the position of the stopping device further comprises:

pulling the elastic cord past the neck into the circular opening; and allowing the elastic cord to expand in diameter within the circular opening by releasing the elastic cord.

* * * * *